US005472365A

United States Patent [19]

Engel

[11] Patent Number: 5,472,365

[45] Date of Patent: Dec. 5, 1995

[54] POLYGON ATTACHMENT SYSTEM FOR CONSTRUCTING POLYHEDRA

[76] Inventor: Richard J. Engel, 835375 Painted Church Rd., Captain Cook, Hi. 96704

[21] Appl. No.: 242,608

[22] Filed: May 13, 1994

Related U.S. Application Data

[63] Continuation-in-part of Ser. No. 61,570, May 17, 1993, abandoned.

[51] Int. Cl.[6] ..... A63H 33/12; A63H 33/00; A63H 33/08

[52] U.S. Cl. ..... 446/104; 446/112; 446/115; 446/126; 403/DIG. 10; 403/170; 52/645; 52/DIG. 10

[58] Field of Search ..... 211/189, 198; 52/DIG. 10, 645, 648.1; 403/174, 170, 178, DIG. 10; 446/104, 102, 108, 111, 112, 113, 114, 115, 116, 120, 121, 122, 125, 126

[56] References Cited

U.S. PATENT DOCUMENTS

| | | | |
|---|---|---|---|
| 2,208,049 | 7/1940 | Pajeau . | |
| 2,410,874 | 11/1946 | Greenberg et al. | 211/189 X |
| 2,414,716 | 1/1947 | Carson | 446/112 |
| 2,776,521 | 1/1957 | Zimmerman . | |
| 3,032,919 | 5/1962 | Amsler . | |
| 3,120,078 | 2/1964 | Bessinger . | |
| 3,271,895 | 9/1966 | Sorensen | 446/104 |
| 3,442,044 | 5/1969 | Quercetti . | |
| 3,554,382 | 1/1971 | Grinbergs | 446/112 X |
| 3,614,835 | 6/1971 | Rice . | |
| 3,827,177 | 8/1974 | Wengel . | |
| 3,968,882 | 7/1976 | Mello | 211/189 |
| 4,055,019 | 10/1977 | Harvey . | |
| 4,065,220 | 12/1977 | Ruga . | |
| 4,090,322 | 5/1978 | Hake | 446/104 |
| 4,253,268 | 3/1981 | Mayr . | |
| 4,270,302 | 6/1981 | Dandia . | |
| 4,309,852 | 1/1982 | Stoplin . | |
| 4,365,454 | 12/1982 | Davis . | |
| 4,474,490 | 10/1984 | Harper, Jr. | 403/218 |
| 4,728,310 | 3/1988 | Valtolina . | |
| 4,792,319 | 12/1988 | Suagerko . | |
| 4,856,928 | 8/1989 | Savale | 403/178 X |
| 5,100,358 | 3/1992 | Volgger . | |
| 5,121,526 | 6/1992 | Burkard . | |
| 5,137,485 | 8/1992 | Penner . | |
| 5,183,430 | 2/1993 | Swann | 446/104 |

FOREIGN PATENT DOCUMENTS

| | | | |
|---|---|---|---|
| 2102466 | 2/1983 | United Kingdom | 403/170 |

*Primary Examiner*—Robert A. Hafer
*Assistant Examiner*—D. Neal Muir
*Attorney, Agent, or Firm*—Dean A. Craine

[57] ABSTRACT

A geometric toy construction system has a multiplicity of flat, regular polygonal construction panels interengageable edge-to-edge by means of shared but separate intervening cylindrical axles positioned parallel to the edges of the panels and attached thereon, thereby enabling the building of two- and three-dimensional constructions. One axle enables up to six panels to be snap-fit into position about the axis of their commonly shared axle.

11 Claims, 5 Drawing Sheets

POLYGON ATTACHMENT SYSTEM FOR CONSTRUCTING POLYHEDRA

This is a continuation-in-part of application Ser. No. 08/061,570 filed on May 17, 1993 now abandoned.

BACKGROUND OF THE INVENTION

1. Field of the Invention

This invention relates generally to geometric toy construction systems and, more particularly, to a system including planar geometric panels of selected regular polygonal shapes incorporating shared but separate connector axle devices attached edge-wise about the periphery thereof, enabling the panels to be interengaged to form two- and three-dimensional arrays.

2. Description of the Related Art

There are numerous prior art construction systems intended to enable the construction of three-dimensional figures using a variety of uniquely shaped and configured building elements. Many of these systems have been created and marketed as toys for amusement and educational purposes, intended to make use of basic principles of construction and geometry to "teach" construction principles in a diverting and amusing fashion.

"Hub and strut" construction sets (marketed under the trade names Tinker Toy, Erector, Ramagon, etc.) have been devised to enable the building of more or less open lattice type space frame structures. But these are difficult for children to manipulate due to the size and variety of pieces offered and the fact that the child is forced to start the construction "from scratch" without the aid of building elements already configured in the form of basic polygonal shapes from which the more complex polyhedra can be built.

Interconnectable "building block" or "lincoln log" type designs (marketed under the trade names Lego, Flexi-block, Krinkles, Lincoln Logs, etc) have been designed to enable the construction of building and mechanical devices. However, due to the basic cubic or rectangular block configuration of the pieces, they are incapable of forming most regular geometric polyhedral shapes.

"Planar polygon" type construction devices comprise another category of geometric construction sets. Kits of this type (marketed under the trade names of Polydron, Googolplex, Linxx, Waffle, Snapland, etc.) enable relatively flat planar geometric shapes to be connected edgewise either parallel to or perpendicular to the longitudinal axis of the shape's edge. The invention described herein is an improved version of this general category.

The principles behind the use of such planar shapes occur naturally in, for example, the molecular structure of chemical compounds and crystals. Use of such shapes in an educational setting helps the user to develop a "feel" for naturally occurring structures. By creating a sense of how planar shapes and spaces interact to form three-dimensional systems, the groundwork is laid to more meaningfully explain to a user how atoms arrange themselves in space to form molecules, or how planar building panels may be utilized to create a well-designed and attractive living space. There have been numerous prior efforts by others to create and design such planar building systems. For example, U.S. Pat. Nos. 5,183,430 (Swann); 4,090322 (Hake); 4,065,220 (Ruga); 4,055,019 (Harvey); 2,776,521 (Zimmerman); 4,309,852 (Stolpin); 2,414,716 (Carson); 2,786,301 (Torricelli); 4,147,007 (Eppich); 4,253,268 (Mayr); 2,208,049 (Pajeau); 3,442,044 (Ouercetti); 4,270,302 (Dandia); 4,334,868 (Levinrad); 4,365,454 (Davis); 5,137,486 (Glickman); 5,100,358 (Volgger); 4,792,319 (Svagerko); 4,345,762 (Lebelson); 4,728,310 (Valtolina); 5,046,982 (Erickson); 5,137,485 (Penner); 4,425,740 (Golden); 4,836,787 (Boo); 3,614,835 (Rice); 3,726,027 (Cohen); 3,032,919 (Amsler); 2,708,329 (McKee); 3,120,078 (Bessinger); 3,597,858 (Ogsbury); 3,827,177 (Wengel); 3,872,620 (Daenen); 3,921,312 (Fuller); 4,212,130 (Walker); 3,891,335 (Feil); and 4,884,988 (McMurray) all teach systems of planar shapes which are, in one fashion or another, interconnectable.

However, these aforementioned inventions are all limited to either two panel junctions as with U.S. Pat. Nos. 4,055,019; 4,090,322; 2,776,521; 4,309,852; 4,253,268; 5,100,358; 4,792,319; 4,345,762; 4,253,268; 5,046,982; 5,137,485; 4,425,740; 3,032,919; 2,708,329; 3,120,078; 3,597,858; 3,872,620; 3,921,312; 4,212,130; 3,614,835; and 4,911,672; or, if multi-panel junctions are permitted, the invention limits the angular orientation of the panels arranged about the junction to a few specified angles thereby fixing the panels in place so that they cannot rotate freely about the axis of the junction as with U.S. Pat. Nos. 4,270,302; 4,334,868; 4,789,370; 5,121,526; 5,145,441; 4,365,454; 5,137,486; 3,827,177; 3,891,335; and 4,904,108.

U.S. Pat. No. 5,183,430 incorporates integral connectors on panels to permit edgewise interengagement of up to four planar polygons about a junction and the panels can rotate freely about the axis of the junction. However, the connector sets located on the edges of the panels of the invention consist of adjacent and/or alternating male and female like connector sets arranged about the perimeter of the panel which must be brought in contact with oppositely configured connectors on another panel in order to effect the interengagement. This greatly restricts the freedom of construction of multi-polygonal structures as more and more panels are joined together thus locking into place the number, variety and sequence of available connector sets to which additional panels can be interengaged. Often times this results in the necessity to completely restructure or abandon the proposed construction due to the inability to find a panel with the proper disposition of connector sets about its perimeter to permit the completion of the structure as envisioned by the user.

U.S. Pat. No. 4,836,787 which incorporates "hook and loop" type connector material running contiguously about the entire perimeter edge of the panels permits multi-panel freely rotating edge-wise junctions of a variety of planar polygonal panels. However, the patent incorporates separate hook and separate loop connector strips placed alternatively around the entire perimeter of the panels so that edgewise interengagement of the panels can only take place between panels whose surfaces have the same orientation to one another (i.e. all facing the same direction) thereby putting oppositely surfaced hook and loop material in edge-wise contact and thus requiring that the opposed surfaces of each panel be differentiated from each other by means of color coding, texture, etc. This also imposes a severe restriction on the free form assemblage of panels especially with regards to the incorporation of interior partitions in constructions.

U.S. Pat. No. 4,884,988, which also employs "hook and loop" connector elements, is an improvement on U.S. Pat. 4,836,787, in that the hook and the loop connector elements are incorporated in intimate combination around the perimeter of the panels thereby allowing for a completely free form edge-wise multi-panel interengagement of panels freely rotating about the axis of the junction regardless of the orientation of their respective surfaces. However, both "hook and loop" inventions offer no means for precise edge-wise alignment of panels other than by gross visual examination. The cumulative effect of even small misalignments of panels results in significant deformation occurring in the construction. Finally, "hook and loop" connector material readily picks up any lint or hair encountered thus marring its aesthetic appearance after a very short period of use.

SUMMARY OF THE INVENTION

The following definitions will be used throughout the following descriptions:

Apex: the point at which two edges of a planar polygon meet.

Vertex: the point where three or more edges of a polyhedron meet.

Panel: the planar regular polygon having three or more straight edges all with integral hooks and recessed edge sections between the hooks and positioned to engage with one axle along each edge.

Edge: the faces of the panel describing its entire perimeter.

Axle: the substantially cylindrical, rod-shaped element used to connect up to six panels about its axis.

Axis: the center line of the axle running longitudinally through its length.

Recess: the edge of the panel situated between the hooks which is recessed back from the furthermost extension of the edge of the panel in order to accommodate the body of the axle.

Hook: the claw-like devices located at either end of the recess.

Slot: the slits cut into the edge of the panel on either side of the hook to give the hook flexibility.

Socket: the cup shaped depression located at opposite ends of the axle.

The purpose of the invention described herein is to provide for a unique and improved geometric toy construction kit made up of panels to be assembled edge to edge in freely rotating, multi-panel arrays to form two- and three-dimensional shapes of unlimited variety for the elucidation of basic geometric principles and/or amusement purposes.

The preferred method of achieving this objective is a construction set comprised of a variety of panels and one or more lengths of connector axle(s) allowing for edge-wise multi-panel connection of the panels about each axle. The preferred method of accomplishing the connection is by means of a pair of hooks formed on each edge of the panels and positioned equidistant from the center point of the panel edges with a recess between the hooks of sufficient depth to receive the body of the axle, the axles approximately equal in length to the distance between the hooks.

In a preferred embodiment of the hook design, slots are cut into the edge of the panel on either side of and adjacent to the hook to impart flexibility to the hook. In another alternative embodiment of the hook design the hooks are not slotted.

The axle is connected to the panel by forcing it into position between the pair of hooks directly adjacent to the recess and parallel to it, the connection accomplished by means of a snap like action of the hooks seizing the axle so presented. Preferably, a cup-like socket is provided at the ends of the axle to receive the hook when the hook is forced over the rim of the socket and down into the depression formed by the socket as the axle is brought into close contact with the recess in the edge of the panel.

In an alternative embodiment, the axle has a narrowed mid-section to enable it to flex in the middle thereby facilitating the connection of the axle to the hooks.

In still another embodiment of the axle, a narrow, encircling groove is cut perpendicularly to the longitudinal axis of the axle proximal to each end to impart flexibility to the rim of the socket located on the opposite end of the axle thereby facilitating connection of the axle to the hooks.

From one to six panels can thus be attached to an axle simultaneously. In addition any or all of the panels can be rotated freely about an axle limited only by the number of panels simultaneously connected to it. The result is that panels can be brought into near contact edge-wise by simply snapping their hooked edges into a common axle thereby allowing the assembly of two- and three-dimensional constructions.

DESCRIPTION OF THE PREFERRED EMBODIMENT(S)

Figure 1:
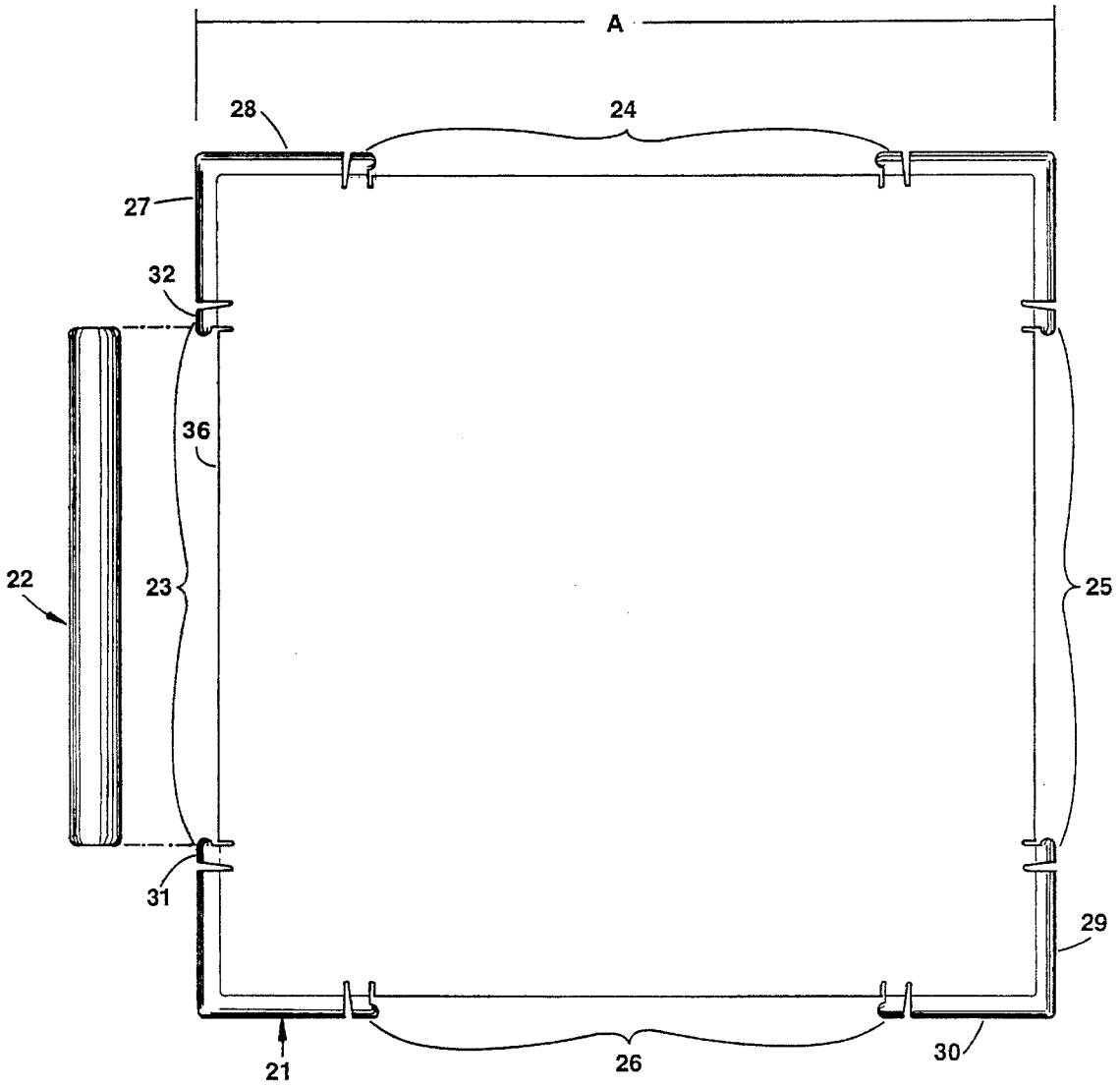
FIG. 1 is a top plan view of a large square panel and an axle.

Referring now to FIG. 1, reference numeral 21 indicates generally a planar, polygonal construction panel comprising the operational features present on all the panels embodying the preferred slotted hook design of the present invention. Reference numeral 22 indicates generally a cylindrical, rod-shaped axle embodying the preferred operational features present with the axles comprising the present invention. It is contemplated that each of the panels disclosed herein will be injection molded using a plastic material which will allow for precise detailing and close tolerances of the interconnecting members to be described herein below, as well as providing the necessary flexibility for linking panels.

Panel 21 is one embodiment of the invention manufactured in the shape of a large square. For the purposes of this application, we will consider the approximate edge-wise dimension of the large square shown in FIG. 1 to be represented by the letter "A". In the preferred embodiment of the invention, "A" is approximately 5 inches.

Figure 2:
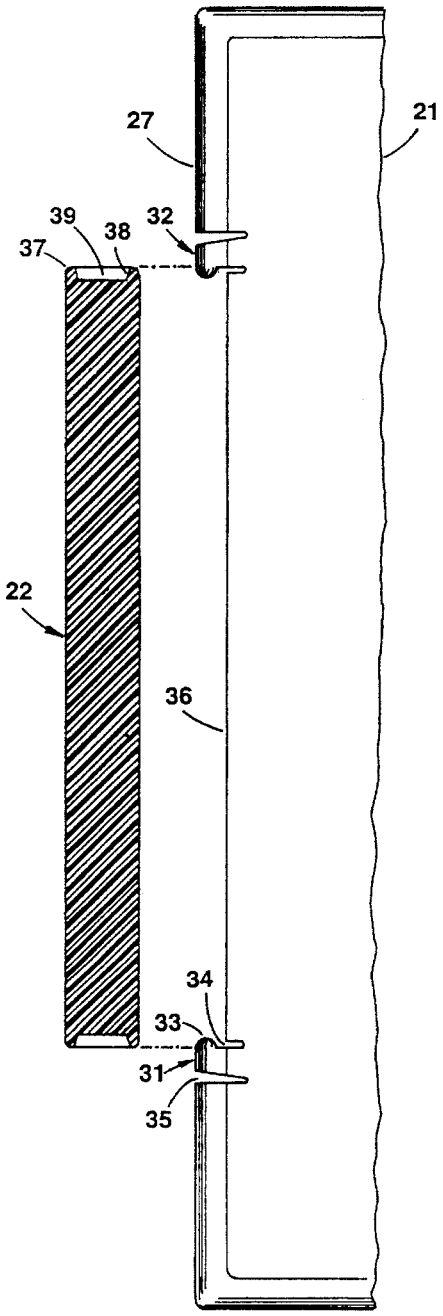
FIG. 2 is an enlarged, top plan view of a section of the square panel and axle shown in FIG. 1.
Figure 4:
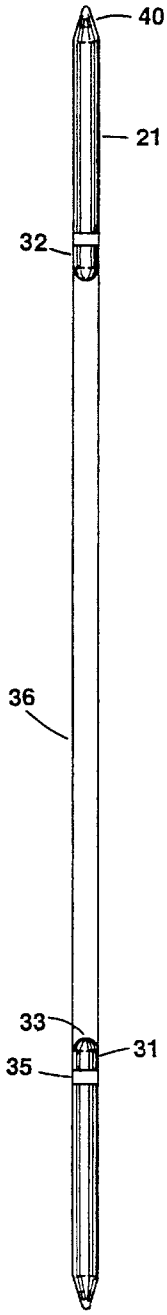
FIG. 4 is a side elevational view of the section of the square panel section shown in FIG. 2.

Panel 21 has four connector sets 23, 24, 25, and 26 formed along, respectively, edges 27, 28, 29, and 30 with each the connector set centered or symmetrically placed on its respective edge. Referring more particularly to connector set 23, the connector set comprises a pair of outwardly extending hooks 31 and 32. As best seen in FIG. 2, each hook (hook 31 shown) has a claw 33 formed at its tip. The claw 33 is aligned to face towards the center of the edge 36 of panel 21 on which the hook 31 is located. In like fashion, the opposite hook 32 has an identical claw formed thereon. In the embodiment shown in FIG. 2, two slots 34, 35 are formed and perpendicularly along the edge 27 on either side of the hook. The slots have sufficient depth to impart flexibility to the hooks to permit them to be bent away from and towards the center of the edge on which they are situated thereby facilitating the connection described herein below. In the preferred embodiment, the distance between hooks 31 and 32 is approximately 3 inches and is the same for all edges of panels equal to length "A".

Again referring to FIG. 1, the edge between hooks 31 and 32 is recessed back from the furthermost extension of edge 27 of panel 21 forming a recess 36 running parallel to edge 27 and of sufficient depth to partially accommodate the insertion of the body of the connector axle 22.

Figure 3:
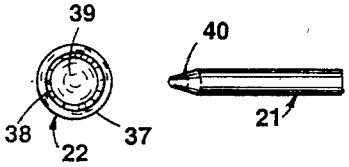
FIG. 3 is a top view of the axle and section of the square panel shown in FIG. 2.

Still referring to FIG. 1, axle 22 is a solid, substantially cylindrical, rod-shaped connector piece embodying most of the preferred, operative features of the axles described in the present invention. As best seen in FIGS. 2 and 3, the ends of axle 22 have a socket 37 formed therein, with each socket 37 having a tapered sidewall 38 and a flattened bottom 39. The length of axle 22 is approximately equal to the distance between hooks 31 and 32 found on all panel edges of standard length "A".

Figure 5:
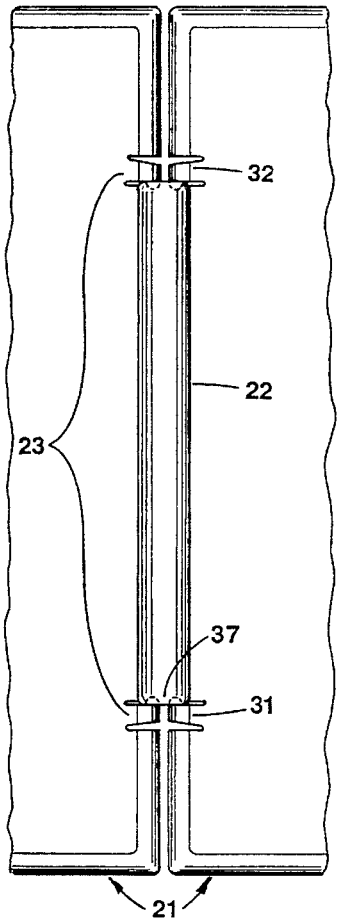
FIG. 5 is a top plan view of two, adjacent square panel sections joined together along their edges about an axle.

As seen in FIG. 5, the hook connector sets 23 and the sockets 37 on the ends of axle 22 are configured to allow the manual frictional interengagement and disengagement of the panels 21 with axle 22, by inserting the opposite acting hooks 31 and 32 of the panels 21 into the sockets 37. Thus, any panel 21 in the present invention may be interengaged with any axle 22 whose distance separating the hooks found along each edge equals the length of the axle. Likewise, all panels 21 of any polygonal configuration whose distance between the hooks 31, 32 is equal to the length of the axle 22 can be interengaged with that same axle, 22 sharing it in common with other panels 21 so interengaged and up to a total of six panels 21 can be simultaneously arrayed about the axis of the axle 22.

Figure 6:
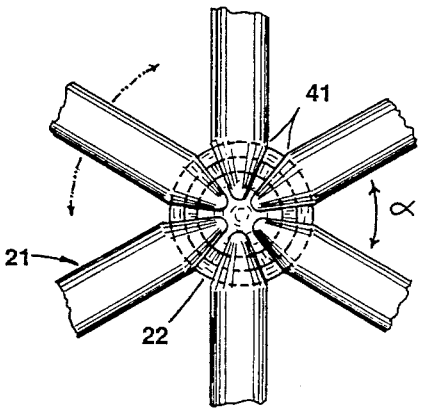
FIG. 6 is an enlarged top view of six panel edges joined together about an axle.

FIG. 6 shows an enlarged, overhead view of the edges of six panels 21 arrayed about the axis of axle 22.

Referring again to FIG. 3, in the preferred embodiment, the panel 21 has a tapered edge 40 formed over the entire perimeter of the panel 21 in order to facilitate the simultaneous interengagement of the maximum number of panels about an axle 22.

It is a significant aspect of the present invention that the axle 22 permits more than two panels 21 to be held in position nearly to within edge-wise contact with the other adjacent panel(s) and parallel to their edges and in exact alignment thereof. Referring again to FIG. 6, it is a further aspect of the present invention that any or all of the panels are able to freely rotate in a 360 degree arc around the axis of the axle 22. In addition, the faces of adjacent panels can be rotated into position relative to one another preferably to include an angle (denoted as $\propto$) of less than 37 degrees between their faces, the rotation only limited by where the corners 41 of their tapered edges 40 come in contact thereby precluding further closing rotational movement.

Figure 7:
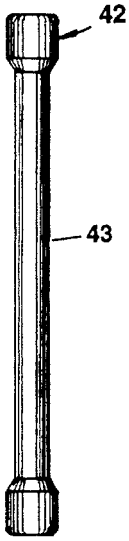
FIG. 7 is an enlarged plan view of an axle with a narrowed mid-section.

FIG. 7, shows an alternative embodiment of the axle, reference number 42, with a narrowed, mid-section 43 running parallel to the longitudinal axis of the axle 42. The mid-section 43 has a radius somewhat shorter than the radius of the ends of the axle 42 in order to impart flexibility to the mid-section 43. This feature enables the axle 42 to bend in the middle thereby facilitating the connection of the axle 42 to the hooks 31, 32.

Figure 8:
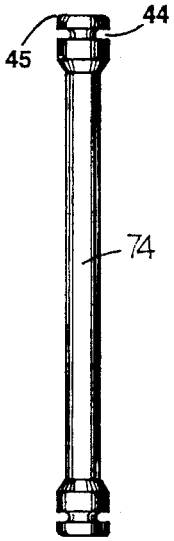
FIG. 8 shows an enlarged plan view of an axle with a groove formed on each end thereof.

FIG. 8 shows another alternative embodiment of the axle, reference number 74, similar to axle 42 but with an encircling groove 44 formed near each end perpendicular to the longitudinal axis thereof designed to impart flexibility to the rim 45 of the socket 37, thereby facilitating connection of the axle 74 to the hooks 31, 32.

Figure 9:
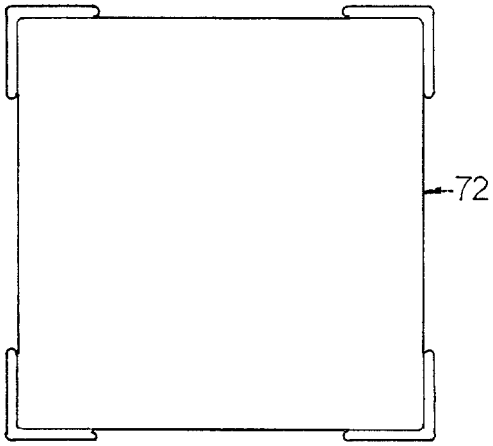
FIG. 9 is a top plan view showing a panel without slots located adjacent to the hooks.

FIG. 9 shows a reduced, top plan view of an alternate panel 72 without slots formed adjacent to the hooks.

Figure 10:
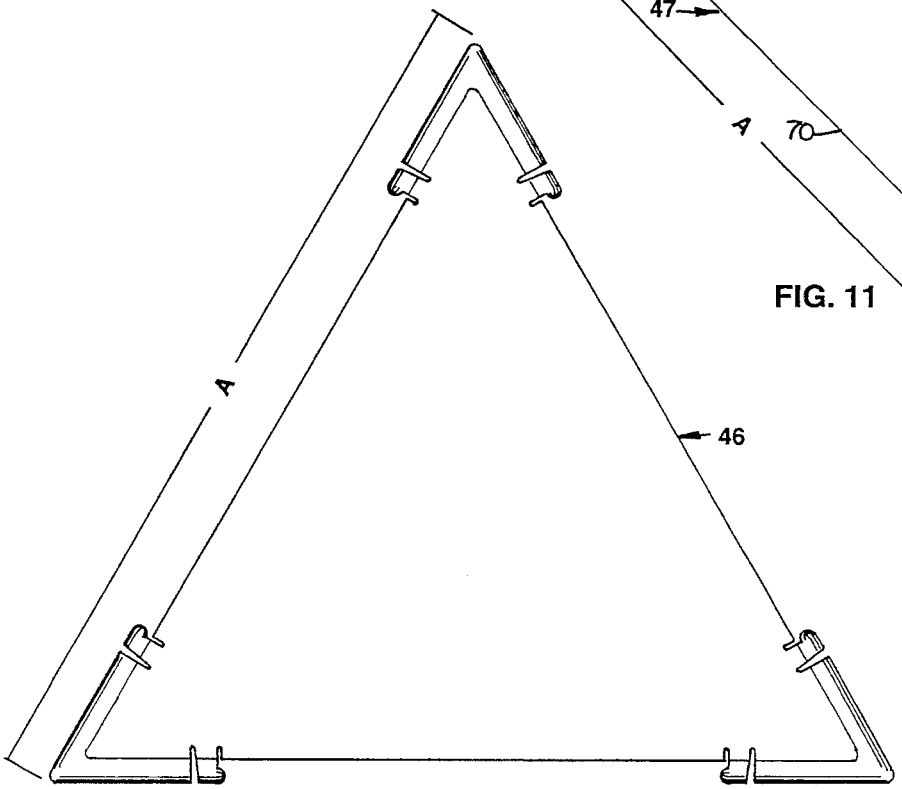
FIG. 10 is a top plan view of a large equilateral triangle panel.

In FIG. 10, another configurational variation of the panel is illustrated, denoted as panel 46, in the shape of a large equilateral triangle. In panel 46, the edge of the equilateral triangle is approximately equal to the standard edge-wise dimension "A" on panel 21.

Figure 11:
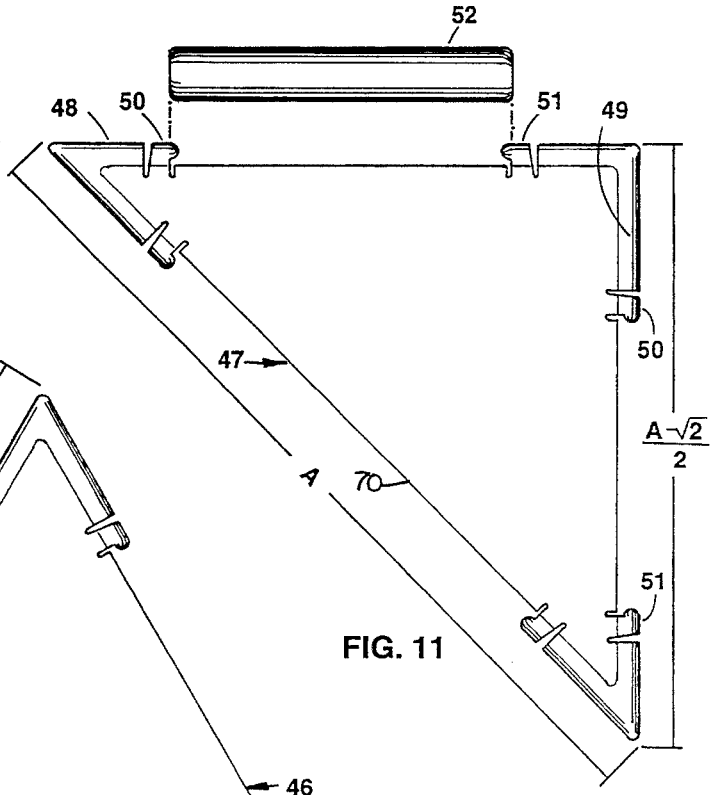
FIG. 11 is a top plan view of an isosceles right triangle panel and an axle.

Other configurational and dimensional panel variations may be illustrated by FIG. 11 where standard edge-wise dimension "A" is approximately equal to the hypotenuse 70 of an isosceles right triangle 47, with the short legs 48 and 49 of the triangle 47 having a dimension approximately equal to $$\frac{A\sqrt{2}}{2}.$$

The preferred distance between hooks 50 and 51 located on edges 48 and 49 and all other edges of panels whose edge dimension equals $$\frac{A\sqrt{2}}{2}$$

is approximately 2 inches. Likewise the length of axle 52 is also approximately 2 inches in order to facilitate the interengagement of the axle with the hooks.

Figure 12:
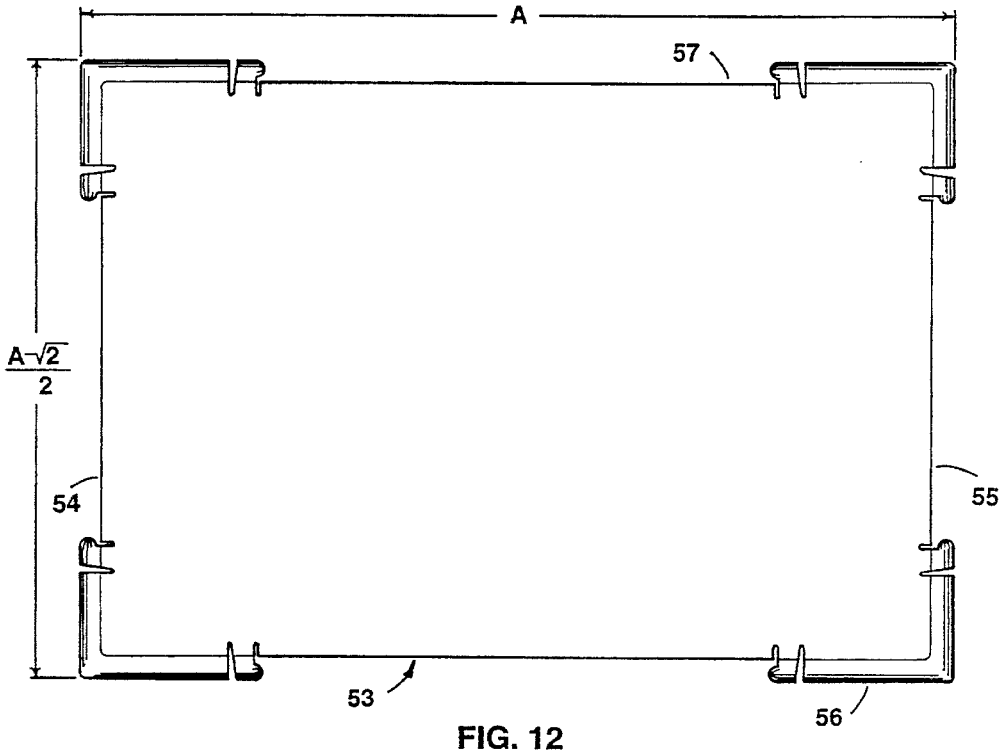
FIG. 12 is a top plan view of a rectangle panel.

Referring now to FIG. 12, a flat planar panel 53 in the shape of a rectangle is shown. Opposite width-wise, shorter edges 54 and 55 are approximately equal in length to $$\frac{A\sqrt{2}}{2}$$

while the opposite length-wise, longer edges 56 and 57 are approximately equal to the standard dimension "A".

Figure 13:
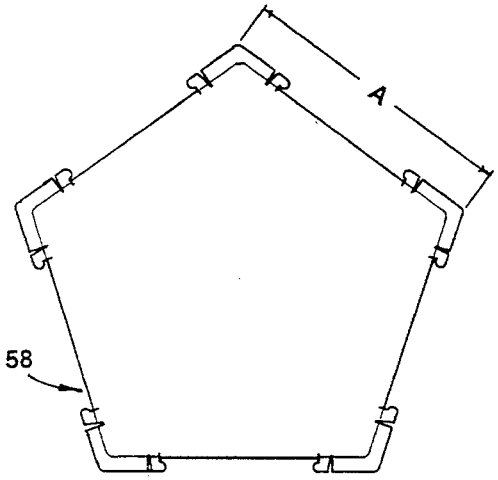
FIG. 13 is a reduced top plan view of a pentagon panel.

FIG. 13 is a reduced, top plan view of regular pentagon panel 58 whose edge length is approximately equal to "A".

Figure 14:
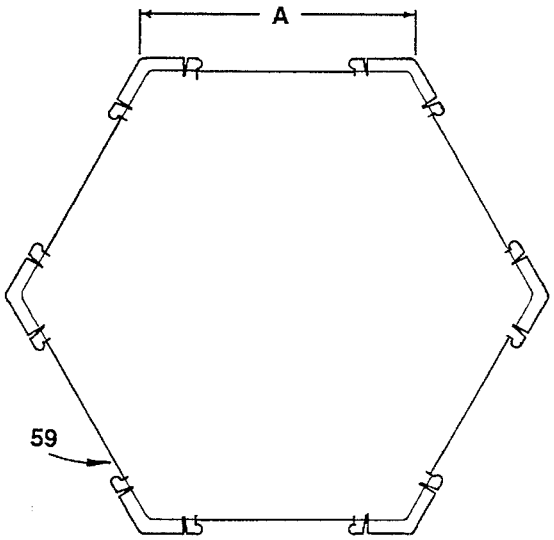
FIG. 14 is a reduced top plan view of a hexagon panel.

FIG. 14 is a reduced plan view of regular hexagon panel 59 whose edge length is approximately equal to "A".

Figure 15:
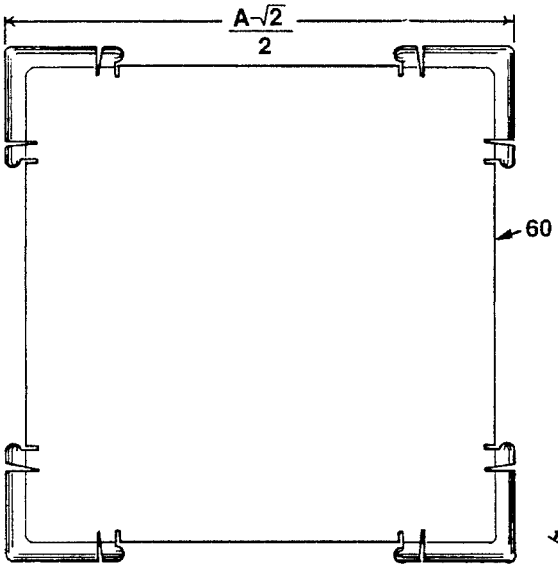
FIG. 15 is a reduced top plan view of a small square panel.

FIG. 15 is a reduced plan view of a small square panel 60 whose edge length is approximately equal to $$\frac{A\sqrt{2}}{2}.$$

Figure 16:
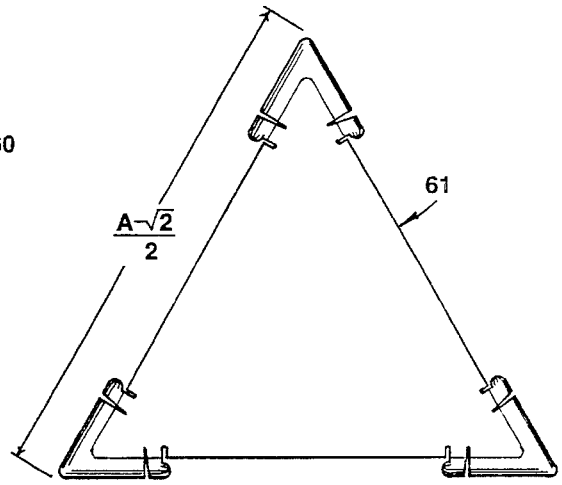
FIG. 16 is a reduced top plan view of a small equilateral triangle.

FIG. 16 is a reduced plan view of a small equilateral triangle 61 whose edge length is approximately equal to $$\frac{A\sqrt{2}}{2}.$$

Figure 17:
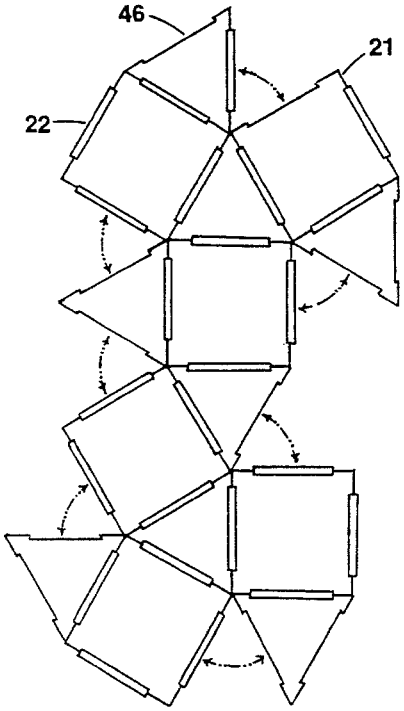
FIG. 17 is a top plan view of a two-dimensional co-planar array of panels and axles prior to being formed into a three-dimensional construction.

FIG. 17 shows a co-planar two-dimensional assembly of six square panels 21 and six equilateral triangles 46 connected edgewise by axles 22 prior to making the final connections required to configure the panels into a three dimensional polyhedron.

Figure 18:
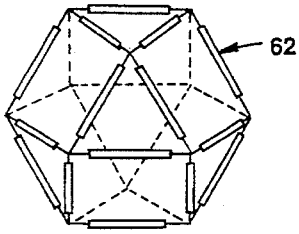
FIG. 18 is a top plan view of the three-dimensional construction resulting from connecting all of the panels in two-dimensional array shown in FIG. 17.

FIG. 18 is the three dimensional cube-octahedron polyhedron 62 formed by connecting together all of the panels shown in FIG. 17.

Figure 19:
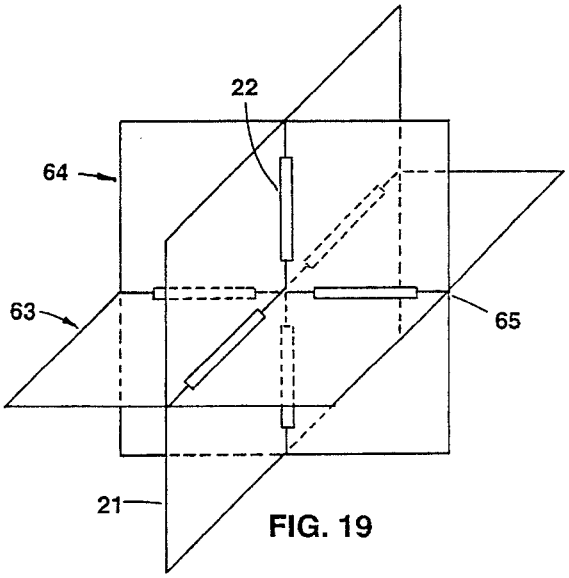
FIG. 19 shows the four panel junctions formed by means of axles in the construction of two intersecting planes.

FIG. 19 shows the intersection of two perpendicularly oriented planes 63 and 64 formed by the interconnection of twelve square panels 21 by means of six axles 22 thereby forming four panel junctions 65 about the panels' commonly shared axles.

Figure 20:
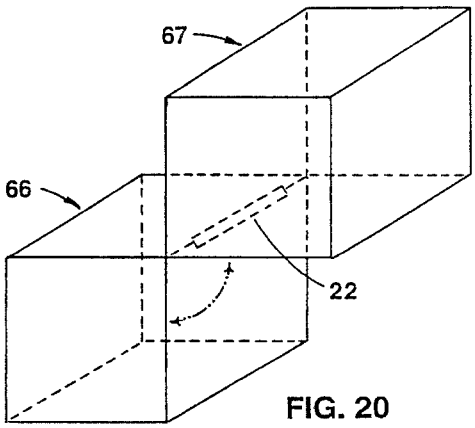
FIG. 20 shows two cubes hinged together by means of an axle.

FIG. 20 illustrates how two cubes 66 and 67 can be joined at the corner by their commonly shared axle 22 thereby permitting a hinging movement between the cubes relative to each other about the axis of the axle.

While the foregoing has presented certain preferred embodiments of the present invention, it is to be understood that these embodiments are presented by way of example only. It is expected that others skilled in the art will perceive variations which, while differing from the foregoing, do not depart from the spirit and scope of the invention as herein described and claimed, and the examples contained herein are not intended to limit the scope of the invention.

I claim:

1. A geometric toy construction system, said system comprising:

substantially flat, substantially planar construction panels of polygonal shape, each of said panels terminating at three or more straight peripheral edges;

said edges approximately equal in length to dimension "A" identified as first panel edges, otherwise, others of said edges approximately equal in length to dimension $$\frac{A\sqrt{2}}{2}$$

identified as second panel edges, each said edge having a center point;

substantially cylindrical shaped solid axles, each said axle having a longitudinal axis with opposite ends oriented in a plane perpendicular to said longitudinal axis of said axle, each said axle having a radius;

said axles equal in length to a first standard length identified as first axles, otherwise, others of said axles are equal in length to a second standard length identified as second axles;

socket means formed on said ends of said axles for selectively connecting and disconnecting said panels to said axles;

hook means formed on said edges of said panels for selectively connecting and disconnecting said panels to said axles;

said hook means including one pair of hooks integral with and extending outward from all edges of said panels;

said hooks positioned symmetrically about said center point of said edges;

each of said hooks having a body generally perpendicular to the edge of said panel, but in the plane of said panel, said body terminating in a claw-like protuberance extending perpendicular from said body towards said center point of said edge;

said hooks formed on said first panel edge identified as a first hook set;

said first hook set being separated by a distance equal to the first standard length;

said hooks formed on said second panel edge identified as a second hook set;

said second hook set being separated by a distance equal to the second standard length;

means formed between said hooks for partially receiving the body of said axles;

said means consisting of a recessed edge identified as a recess;

said recess having a depth slightly greater in length than said radius of said axle;

said first and said second standard distances being selected to enable the connection of said first axles with said first hook set and said second axles with said second hook set;

said connection of said panels with said axles being accomplished by positioning said axles parallel to said edges and centered in between said pair of hooks then forcing said axles into contact with said recess thereby forcing said hooks to seize said axles by snapping said protuberances into said socket means.

2. The construction system of claim 1 in which several of said panels are in the shape of a first regular polygon, several of said panels are in the shape of a second regular polygon, several of said panels are in the shape of a third regular polygon, several of said panels are in the shape of a fourth regular polygon, several of said panel are in the shape of a fifth regular polygon, several of said panels are in the shape of a sixth regular polygon, several of said panels are in the shape of a seventh regular polygon, and several of said panels are in the shape of an eighth regular polygon.

3. A geometric toy construction system comprising:

a) a plurality of substantially flat, substantially planar construction panels of various polygonal shapes capable of being connected together to form a plurality of polyhedral shapes, each said panel having at least three peripheral edges, each said edge having a center point;

b) a substantially cylindrical-shaped connector axle having a longitudinal axis with opposite recessed ends oriented in a plane perpendicular to said longitudinal axis of said connector axle, each axle having a radius;

c) said recessed ends being a socket for selectively connecting and disconnecting said adjoining panels to said connector axle;

d) a pair of outward extending hooks disposed on each said peripheral edge capable of selectively connecting and disconnecting said panel to said connector axle sockets, said pair of hooks being spaced apart approximately equal to the length of said connector axle and approximately equal distance from said center point of said peripheral edge, each said hook having a claw-like protuberance that extends perpendicular therefrom towards said center point of said peripheral edge;

e) a recess located along said peripheral edge between said hooks capable of partially receiving said connector axle, said recess having a depth slightly greater in length than the radius of said connector axle, and;

f) whereby said panels may be connected together to form said polyhedral shape by aligning said recesses on said adjacent panels and positioning one said connector axle between said recesses and interengaging said pair of hooks on each said adjacent panel into said sockets on said connector axle.

4. A geometric toy construction system, as recited in claim 3, further comprising, each said peripheral edge having tapered sides thereby enabling a plurality of panels to be connected to one said connector axle.

5. A geometric toy construction system, as recited in claim 4, further comprising two slots aligned perpendicular to said peripheral edge and located on opposite sides of said hooks thereby imparting increased flexibility to said hooks.

6. A geometric toy construction system, as recited in claim 3 further comprising a connector axle having a mid-section with a radius shorter than the radius of the ends of said axle thereby enabling said connector axle to flex near said mid-section to facilitate connection of said connector axle to said hooks on said panel.

7. A geometric toy construction system, as recited in claim 3 further comprising a connector axle having an encircling groove formed near said opposite ends thereof to enable said socket to flex to facilitate connection of said connector axle to said hooks on said panels.

8. A geometric toy construction system, as recited in claim 3 wherein said panel is square shaped.

9. A geometric toy construction system, as recited in claim 3 wherein said panel is a triangle.

10. A geometric toy construction system, as recited in claim 3 wherein said panel is a pentagon.

11. A geometric toy construction system, as recited in claim 3 wherein said panel is a hexagon.

* * * * *